US005103068A

United States Patent [19]

Schrader

[11] Patent Number: 5,103,068

[45] Date of Patent: Apr. 7, 1992

[54] CONNECTOR TWIST TIE

[75] Inventor: Gary E. Schrader, Manchester, N.H.

[73] Assignee: Burndy Corporation, Norwalk, Conn.

[21] Appl. No.: 655,988

[22] Filed: Feb. 15, 1991

[51] Int. Cl.[5] ..... H01R 4/18; H01R 43/04

[52] U.S. Cl. ..... 174/94 R; 29/863; 174/71 R; 174/840; 403/275; 403/391; 439/877

[58] Field of Search ..... 174/94 R, 71 R, 84 R, 174/84 C; 403/391, 27 5; 439/877; 29/861, 863

[56] References Cited

U.S. PATENT DOCUMENTS

| | | | |
|---|---|---|---|
| 2,707,775 | 5/1955 | Hoffman et al. | 174/94 R |
| 2,938,069 | 5/1960 | Toedtman et al. | 174/94 R |
| 2,956,108 | 10/1960 | Brenner | 174/94 R |
| 2,964,585 | 12/1960 | Nilsson et al. | 174/94 R |
| 3,032,603 | 5/1962 | Whitley | 174/94 R |
| 3,053,930 | 9/1962 | Mallanik et al. | 403/391 X |
| 3,183,025 | 5/1965 | Lynch, Jr. et al. | 439/877 |
| 3,235,654 | 2/1966 | Eldridge, Jr. | 174/94 R |
| 3,236,938 | 2/1966 | Toedtman | 174/94 R |
| 3,330,903 | 7/1967 | Holke et al. | 439/877 |
| 3,340,352 | 9/1967 | Teagno et al. | 174/94 R |
| 3,354,517 | 11/1967 | Levinsky | 439/877 |
| 3,408,455 | 10/1968 | Dannes | 174/94 R |
| 3,746,777 | 7/1973 | Peek | 174/94 R |
| 3,781,459 | 12/1973 | Peek | 174/94 R |
| 4,350,843 | 9/1982 | Campbell et al. | 174/94 R |
| 4,940,856 | 7/1990 | Bock | 174/94 R |
| 4,950,838 | 8/1990 | Gordon | 174/94 R |

*Primary Examiner*—Morris H. Nimmo

*Attorney, Agent, or Firm*—Mitchell B. Wasson; Martin P. Hoffman; Burtsell J. Kearns

[57] ABSTRACT

A compressible electrical connector having slots or channels for the inclusion of two or more conductors therein. One or more surfaces of the connector are provided with an extruded groove having a tying device press-fitted therein. After the conductors are inserted into the various slots or channels of the connector, the tying device would be tied or twisted around each end of the conductor bundles prior to implementing the crimping process.

8 Claims, 2 Drawing Sheets

CONNECTOR TWIST TIE

BACKGROUND OF THE INVENTION

This invention broadly pertains to electrical connectors for wire or cable conductors. More specifically, the invention relates to a compressor-type electrical connector for connecting a plurality of connectors together in an electrical power distribution system. The invention finds particular application in establishing a tap connection to provide a branch current from a continuous run main power cable. An electrical connector of the aforesaid type is typically adapted to receive a tap connector, to engage a continuous run conductor, and to be compressed by means of a crimping tool to achieve the desired connection.

However, a problem exists preparatory to the crimping process, whereby one or more of the conductors or cables "pop out" of their respective slots before the crimping tool can be applied and the connector compressed. This problem has previously been recognized and addressed in various manners, as shown with respect to U.S. Pat. Nos. 2,964,585 issued to Nilsson et al; 3,032,603 issued to Whitley and 3,183,025 issued to Lynch, Jr. et al.

The Nilsson et al patent describes a parallel tap connector adapted to effect inter-engagement between a main line and one or more branch lines to maintain the lines in electrical contact at the point of engagement without external holding devices. The connector contains various channels 11,12 adapted to receive various cables or conductors therein. A pair of springs 17, associated with channel 11, is attached to the connector and bent in such manner to coact with the cable or conductor to prevent it from becoming dislodged from the connector.

The patent to Whitley is directed to a connector with a temporary holding device placed into the slot or other opening in the connector device. This temporary cable holding device comprises a spring clip 16 generally in a U-shaped configuration adapted to conform to various ridges provided in the interior channels of the connector.

The patent to Lynch, Jr. et al also describes a connector with a temporary cable holding device. This temporary holding device consists of an end plate 20 which is adapted to be provided at one or both ends of the connector.

An additional relevant prior art connector is manufactured by Kearny, such as shown in U.S. Pat. No. 2,707,775, and consists of an H-frame copper compression connector provided with one or more impacted tabs provided adjacent to the channels for receiving the conductors. The purpose of these tabs is to hold the connector in place before and during the crimping operation. Although aluminum compression connectors having these tabs can be manufactured in a single extrusion process, copper compression connectors must use a two-step process for including these tabs in the connector structure.

SUMMARY OF THE INVENTION

The present invention overcomes the deficiencies of the prior art by producing a connector which is less costly to manufacture than the prior art connectors, due in part to its ease of manufacture. A groove is provided in one or more surfaces of the connector and an elongated tying device is press-fitted into the groove. This tying device extends for a sufficient length on either end of the grooved surface so as to be tied or twisted around both ends of a conductor or conductors preparatory to the crimping process.

BRIEF DESCRIPTION OF THE DRAWINGS

The foregoing and other objects and advantages of the present invention will be better understood with reference to the following detailed description of preferred embodiments thereof, which are illustrated, by way of example, in the accompanying drawings, wherein.

DETAILED DESCRIPTION OF THE INVENTION

Figure 1:
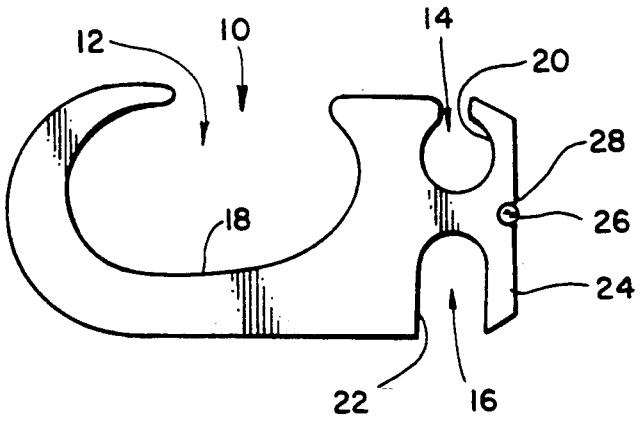
FIG. 1 is an end elevational view of a first embodiment of the present invention.
Figure 2:
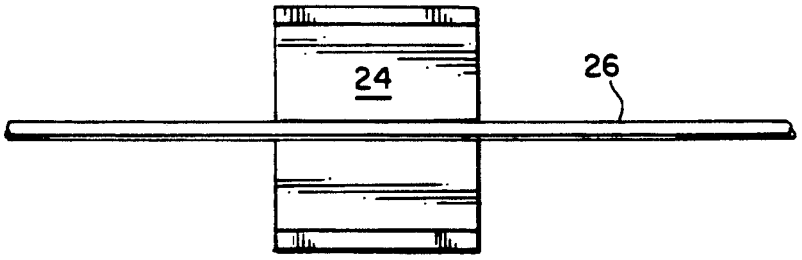
FIG. 2 is a bottom elevational view of the first embodiment of the present invention.

FIGS. 1 and 2 illustrate a first embodiment of the present invention employing a FIG. 6-type compression connector 10. This connector contains slots or channels 12,14 and 16 to accommodate one or more single strand, multi-strand conductors or cables. Surfaces 18, 20 and 22 are provided in the interior of the respective slots or channels to accommodate the various conductors or cables. Although this connector is provided with differently-sized slots or channels 12, 14 and 16, this need not be the case, and these slots or channels can be of equal dimension. The bottom surface 24 of this connector has been extruded with a groove 28 extending for the entire width of the bottom surface 24. A copper twist tie 26 is secured into the groove 28 of the connector 10 and is of sufficient length to be twisted around the conductor or conductors, thus providing a holding and tying device for the conductors within the connector. This particular connector can be manufactured from tin-plated copper and, therefore, the entire connector can be extruded in a single operation. The Kearny connector containing one or more securing tabs can only be manufactured from a copper-based material using an impacted tab which would constitute a two-step process. Additionally, the connector illustrated in FIGS. 1 and 2 can be used with various ranges or sizes of conductors or cables.

Figure 3:
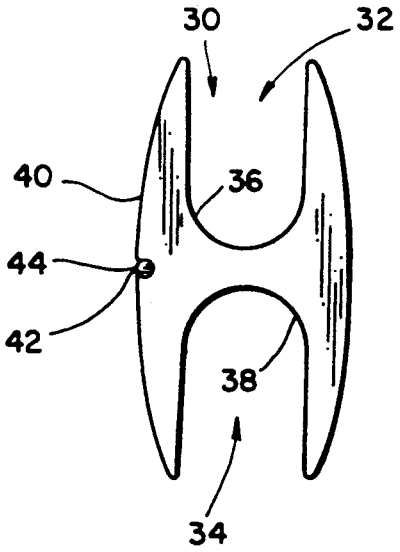
FIG. 3 is an end elevational view of a second embodiment of the present invention.
Figure 4:
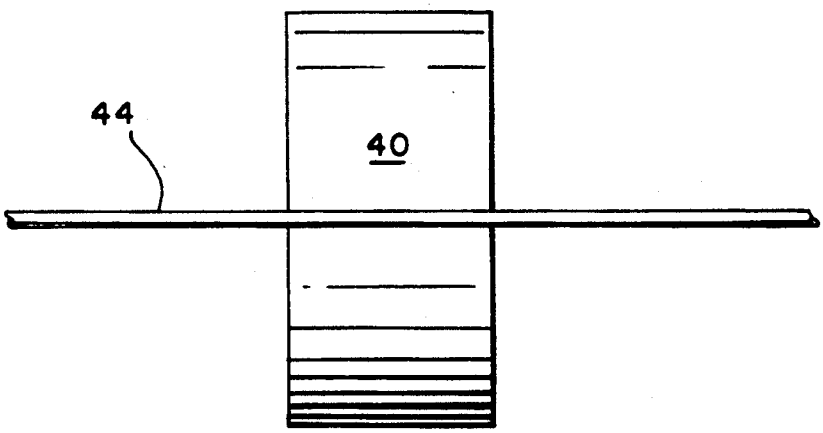
FIG. 4 is a side elevational view of the second embodiment of the present invention.

A second embodiment of the present invention is illustrated with respect to FIGS. 3 and 4. These figures describe a H-frame connector 30 provided with two slots or channels 32,34, each of which contains an inner surface 36 or 38 to allow various conductors or cables to be inserted into the connector 30. A side surface 40 is provided having an extruded groove 42 extending for the entire width of the surface 40. A holding and tying device, such as an elongated piece of wax covered twine 42, is secured into the groove 44 and extends for a sufficient length to be tied around the various conductors. This particular conductor can be manufactured from tin-plated copper, aluminum or similar materials. Additionally, the twine 42 could be manufactured from a tin-plated material.

Figure 5:
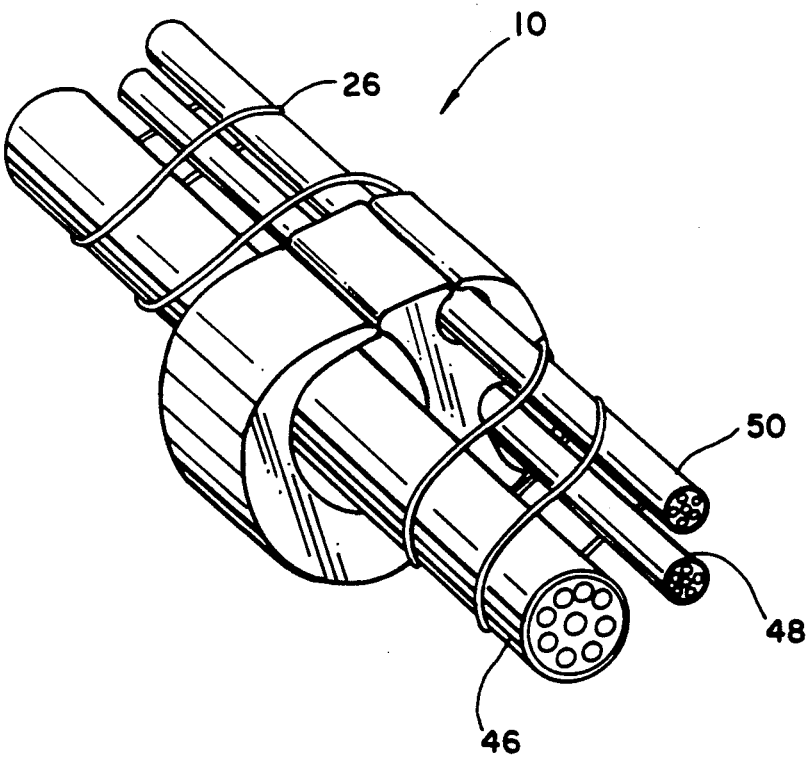
FIG. 5 is a perspective view of the first embodiment of the present invention illustrating the tying arrangement.

FIG. 5 illustrates the application of the present invention to the embodiment illustrated with respect to FIGS. 1 and 2, after the crimping process has been completed. In operation, multi-strand conductors 46, 48 and 50 are inserted into their respective slots or channels 12, 16 and 14. Each end of the copper wire is twisted or tied around the entire group of conductors or cables to secure the cables prior to the crimping process. The connector is then inserted into the proper mechanical, pneumatic or hydraulic crimping tool, and then the crimping process is effectuated. Once this process is completed, the copper twist tie can remain in place or be snipped off.

Although the exact length of the wire or twine used to secure the conductors is not crucial, it has been found that these tying devices can extend from between 10 to 24 inches.

While the preferred embodiments of the present invention have been shown, and described herein, it is obvious that many structural details may be changed without departing from the spirit and scope of the appended claims. For example, although the present invention has been illustrated with respect to H-frame and FIG. 6-type connectors, this need not be the case, and the present invention can be utilized with virtually any type of compressible connector configuration.

What is claimed is:

1. An electrical compression connector adapted to be crimped around one or more electrical conductors, comprising:

a compressible metallic body having at least one exterior planar surface, said metallic body provided with at least two parallel conductor-receiving recesses extending through said metallic body, said exterior planar surface provided with a groove extending for substantially an entire lateral dimension of said planar surface and parallel with said conductor-receiving recesses; and a tying device provided within said groove, said tying device being of sufficient length to be twisted around one or more electrical conductors prior to crimping, to secure said one or more electrical conductors within said conductor-receiving recesses.

2. The electrical compression conductor in accordance with claim 1, wherein said tying device is a metallic wire.

3. The electrical compression conductor in accordance with claim 1, wherein said tying device is a wax covered twine.

4. The electrical compression conductor in accordance with claim 2 wherein said metallic body and said tying device are constructed from a tin-plated copper material.

5. A method of temporarily securing one or more electrical conductors to a connector prior to crimping, comprising the steps of:

providing a compression connector having a metallic body and having at least one exterior planar surface, said metallic body provided with at least two parallel conductor-receiving recesses extending through said metallic body, said exterior planar surface provided with a groove extending for substantially an entire lateral dimension of said planar surface and parallel with said conductor-receiving recesses;

inserting a tying device within said groove, said tying device being of sufficient length to be twisted around one or more electrical conductors;

inserting one or more electrical conductors within said conductor-receiving recesses;

twisting said tying device around said one or more electrical conductors on at least one side of said compression connector, to secure said one or more electrical conductors within said conductor-receiving recesses;

placing said compression connector into a crimping device;

applying pressure to said crimping device to compress said compression connector around said one or more electrical conductors.

6. The method in accordance with claim 5 wherein the excess portion of said tying device is snipped away after said pressure applying step.

7. The method in accordance with claim 5 wherein said tying device is a metallic wire.

8. The method in accordance with claim 5 wherein said tying device is a wax covered twine material.

* * * * *